United States Patent [19]

Hammond

[11] Patent Number: 5,011,402

[45] Date of Patent: Apr. 30, 1991

[54] SUSPENDED FURNACE WALL

[75] Inventor: John A. Hammond, Washington, Pa.

[73] Assignee: Frazier Simplex, Inc., Washington, Pa.

[21] Appl. No.: 410,090

[22] Filed: Sep. 20, 1989

[51] Int. Cl.[5] ..... F27D 1/12; F23M 5/00; F23M 5/08

[52] U.S. Cl. ..... 432/238; 432/233; 110/336; 110/339

[58] Field of Search ..... 110/336, 339; 432/233, 432/238, 248, 249

[56] References Cited

U.S. PATENT DOCUMENTS

| | | | |
|---|---|---|---|
| 3,328,014 | 6/1967 | Longenecker | 432/238 |
| 3,812,798 | 5/1974 | Merkle, Jr. | 432/238 |
| 3,888,195 | 6/1975 | Longenecker | 432/233 |
| 4,705,475 | 11/1987 | Coates | 432/248 |

*Primary Examiner*—Henry A. Bennet
*Assistant Examiner*—Christopher B. Kilner
*Attorney, Agent, or Firm*—Webb, Burden, Ziesenheim & Webb

[57] ABSTRACT

A suspended back wall for a high temperature furnace including a plurality of spaced-apart, vertically extending columns having upper portions supported between spaced girder members to bear loading while permitting lateral thermal expansive and contractive movement of the upper portions of the columns. Lower end portions of the columns are attached to a main support beam which horizontally traverses the width of the suspended wall. A plurality of interlocking refractory tiles are secured on the vertical columns by cast metal hangers. A plurality of insulation slabs or batts are inserted in specially formed pockets between adjacent refractory tiles and columns at a rear face thereof. An air chamber is formed along the rear of the vertical columns and an air duct is provided along the bottom thereof to supply a regulated forced air flow to the air chamber. Emergency air doors are provided at the ends of the duct to provide a natural draft through the air chamber in the event of a loss of forced air draft due to fan failure.

18 Claims, 8 Drawing Sheets

SUSPENDED FURNACE WALL

BACKGROUND OF THE INVENTION

The present invention relates generally to high temperature furnaces for treating molten materials. More particularly, the invention relates to a high temperature wall construction which is suitable for use as a suspended backwall in a glass melting furnace.

The functioning and charging of a typical glass furnace having a conventional suspended backwall or suspended arch, as it is sometimes referred to, is described more fully in U.S. Pat. Nos. 4,197,109 and 3,868,031, both in the names of John Earl Frazier and Clifford F. Crouse.

The suspended backwall having a refractory brick hot face extends downwardly from the roof at the rearward end of the furnace tank and is spaced inwardly from the fixed rear wall of the molten glass tank. The lower edge of the suspended backwall is spaced above the level of the molten glass. This area of the glass furnace is commonly referred to in the art as the "dog house" and provides an open charging area between the level of the molten glass and the lower edge of the suspended backwall into which a batch mixture of raw glass forming solid ingredients is introduced, usually by known feeder or charger apparatus, such as a blanket charger, screw charger, plunger charger or the like.

Heretofore, the construction and maintenance of suspended backwalls have collectively proven to be quite time consuming and expensive. In addition, costly energy losses due to conductive heat transfer through known suspended backwalls has heretofore been a continuous problem in the operation of glass melting furnaces.

The present invention solves many of the problems found in conventional suspended backwalls by providing an insulated furnace backwall construction which greatly reduces heat losses from the furnace while improving the structural integrity of the wall itself.

The present invention further provides a structure which is suitable for use as a suspended backwall, shadow wall, waist wall or furnace roof having a completely closed and fully bonded hot surface face.

Still further, the present invention provides a suspension system for supporting the refractory face tiles having an equalized loading distribution and which permits vertical and horizontal thermal expansion of the suspended refractory tiles. In addition, the present invention provides vertical structural members for supporting the refractory tiles wherein the vertical members are free to move laterally in response to thermal expansion and contraction in the refractory tiles. This improves the thermal and structural integrity of the wall. The refractory tiles of the invention have specially shaped horizontal faces and side edges to matingly engage adjacent tiles on four confronting surfaces to provide a tight and structurally interlocked refractory construction, which prevents so-called "rat holes" from forming in the wall.

Still further, the suspended wall of the present invention provides for continuous and efficient air flow along an inner, cold face thereof to prevent oxidation and weakening of the cast metal refractory hangers without damaging back pressures, as commonly present in prior systems. The invention also provides emergency natural draft air flow in the event of fan failure in the forced air flow system.

In addition, the present invention provides a suspended backwall for a glass furnace having an angularly disposed nose section which may be of a preselected slope to more efficiently, reflectively direct the radiant heat from the burners to the raw charge located in the so-called fritting chamber of the furnace. The refractory tiles forming the suspended wall in the curved or sloped fritting chamber and at the charging end can be selectively removed and replaced from the cold side of the wall during operation, making maintenance much easier than prior wall designs. Still further, the suspended wall of the present invention can be constructed in a shorter time than prior walls of this type, thus enjoying the benefit of lower labor costs.

SUMMARY OF THE INVENTION

Briefly, the present invention is directed to a suspended structure, such as a backwall, for a high temperature furnace and comprises a plurality of spaced-part, vertically extending columns. The upper ends of the columns are positioned between a pair of spaced flanged beam members which horizontally traverse the furnace. Roller means are associated with the upper ends of the columns and bear against the flanges of the beam members to permit movement of the columns therealong in response to thermal expansion and contraction in a lateral direction. Lower end portions of the columns are formed in a rearwardly bent shape and are attached to a main support beam which horizontally traverses the width of the suspended wall. A plurality of refractory tiles preferably having interlocking sides and faces are cemented together and mechanically secured on the vertical columns by cast metal hangers. The hangers are slidable along the columns to accommodate thermal expansion of the refractory tiles in the vertical direction. Horizontally extending thermal expansion joints having metal channels rigidly secured to the columns are vertically spaced along the wall to permit vertical expansion and also to divide and distribute the loading of the refractory tiles to the columns. A plurality of insulation slabs or batts are inserted within pockets formed between the ends of adjacent refractory tiles to face the columns at the cold side thereof. A sheet metal closure is applied along the rear of the vertical columns to define an air chamber along the rear face of the wall. An air duct is provided along the bottom edge of columns to supply a regulated forced air flow to the chamber whereby the rear face of the insulated wall is supplied with an unrestricted free flow of cooling air to prevent weakening of the cast metal hangers and to keep the other structural components at preferred cooler temperatures. The unrestricted air flow along the rear face of the suspended wall also prevents unwanted back pressure in the air chamber which prevents possible blow out of mortar joints between the refractory tiles. In addition, emergency air doors are installed at the ends of the duct to provide a natural draft air flow through the air chamber in the event of loss of forced air draft due to fan failure or the like.

BRIEF DESCRIPTION OF THE DRAWINGS

These, as well as other benefits and features of the present invention, will become apparent when reference is made to the following detailed specification taken with the appended drawings, in which.

DETAILED DESCRIPTION OF THE INVENTION

Figure 1:
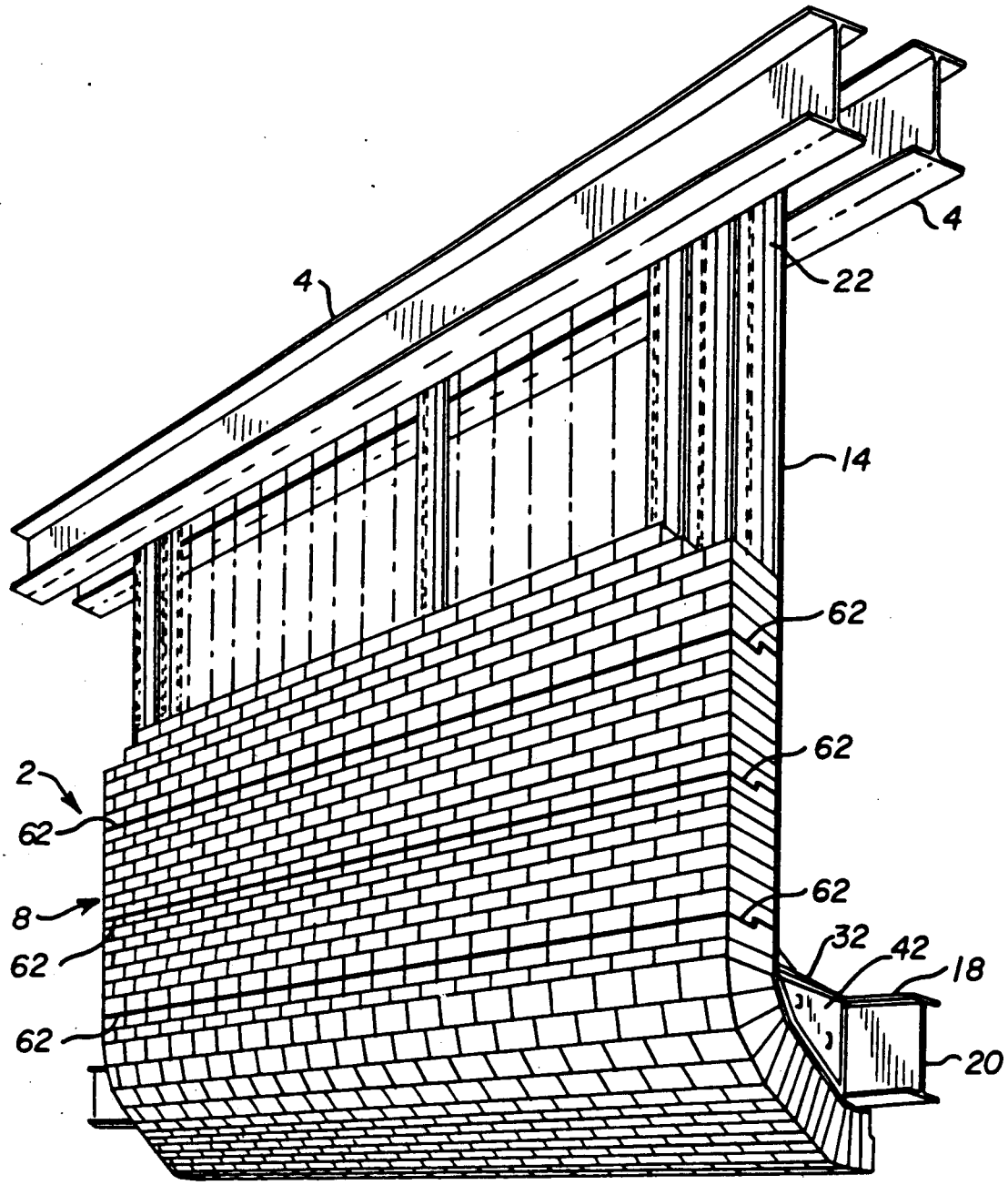
FIG. 1 is a partial perspective view of the hot side of a suspended backwall constructed in accordance with the present invention.
Figure 2:
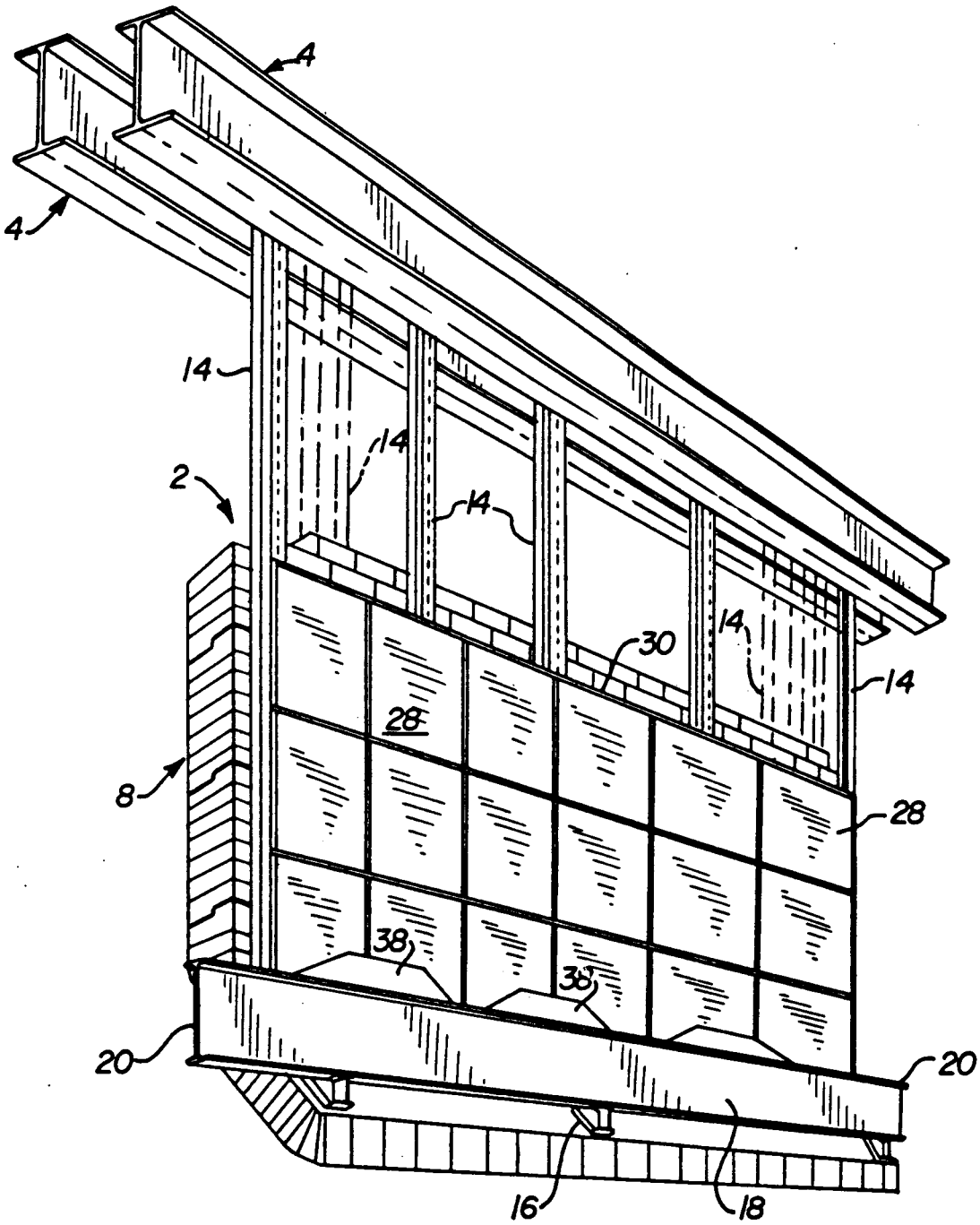
FIG. 2 is a perspective view of the cold side of the suspended wall of FIG. 1.
Figure 3:
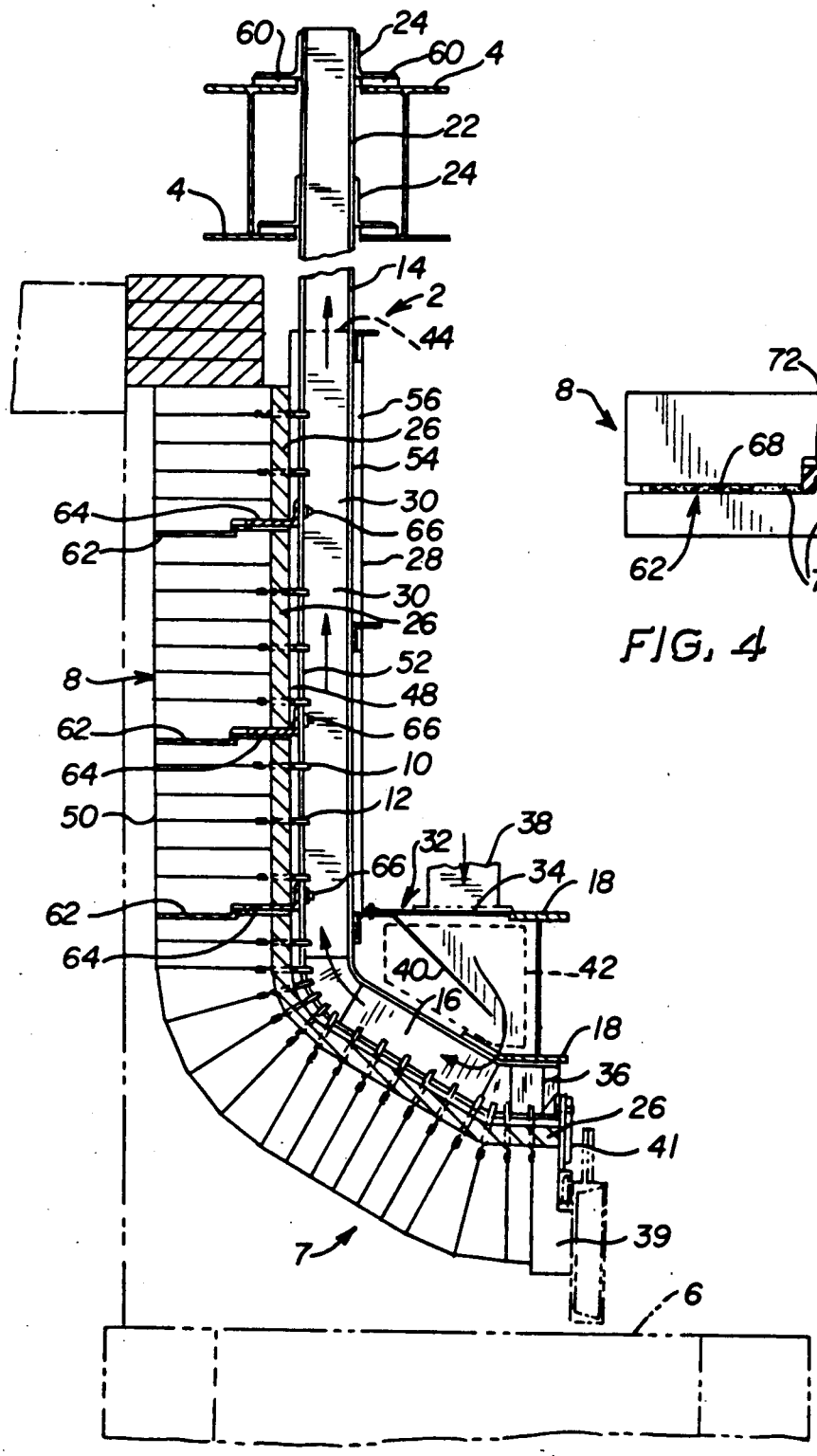
FIG. 3 is a side elevation view of the wall of FIGS. 1 and 2.

Reference is now made to the drawings wherein FIGS. 1–8 depict a suspended wall generally designated 2 which is constructed in accordance with the invention and particularly suited for use as a backwall in a glass melting furnace. Wall 2 is shown in FIG. 3 as extending downwardly from a pair of spaced support beams 4 at the furnace roof to a location closely spaced above the dog house 6 at the charging area of the glass furnace.

The wall 2 comprises a plurality of interlocking refractory tiles, generally 8, which are attached by hangers 10 and 12 to a plurality of spaced-apart, vertically extending columns or stringers 14. The columns 14 are preferably spaced apart on 9 inch center spacings, for example. The lower ends of the columns 14 each include an arcuate or rearwardly bent section 16 which is structurally secured by welding, for example, to a main support beam 18. Beam 18 horizontally traverses the width of the suspended wall 2 and is secured at its ends 20 to other structural members of the furnace (not shown). The upper ends 22 of the columns 14 are moveably supported along the flanges of the beams 4 on L-channels 24. The beams 4 maintain the columns in a vertical alignment and bear transverse loading moments imposed on the columns 14. Roller elements may be employed to moveably support the ends 22 of the columns 14 for travel in a horizontal direction to accommodate thermal expansion and contraction of the refractory tiles supported by the long columns 14.

Figure 3A:
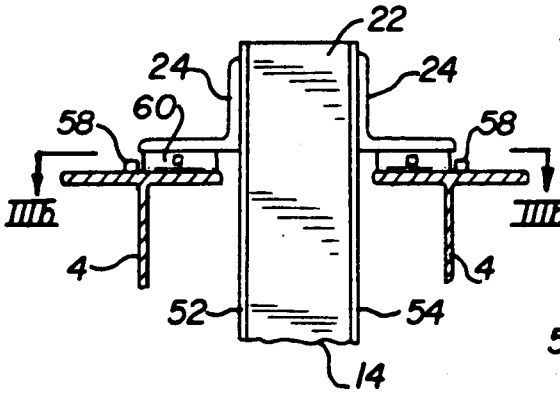
FIG. 3*a* is a partial side view of the upper ends of the vertical columns or stringers having roller supports associated therewith.
Figure 3B:
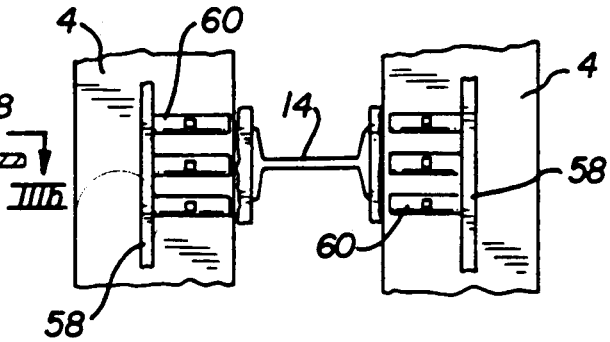
FIG. 3*b* is a plan view taken along line III*b*—III*b* of FIG. 3*a*.

As seen in FIGS. 3*a* and 3*b*, the upper ends 22 of the stringers or columns 14 are preferably fitted with rollers 60 to accommodate for lateral thermal expansion of the refractory 8 coupled to the columns 14. The rollers 60 are situated between the lower flanges of the L-channels 24 and the upper horizontal flanges of the spaced support beams or girders 4. The rollers may be, for example, 1 inch in diameter. A retainer bar 58 is fitted to the girders 4 to insure parallel travel of the channels 24 along the top flanges of the girders 4.

The main beam 18 supports the bearing weight of the wall 2 thereon. A layer of insulation 26 is applied between the refractory tiles 8 and the columns 14, the assembly and insertion of which will be explained in greater detail hereinafter.

An air chamber 30 is formed between the inner, cold face of the refractory tiles 8 along the insulation layer 26 and a spaced wall 28 extending parallel to the plane of cold face. The air chamber wall 28 is preferably made of flanged sheet metal panels secured to the rear webs 54 of the vertical stringers or columns 14. An air duct 32 is formed along the lower edge of the wall 28 enclosed by a flat cover sheet 34 which extends from the beam 18 to the wall 28. The duct 32 communicates with the air chamber 30 through the laterally spaced openings between the vertical columns 14 along the lower ends 16 thereof. A plurality of insert plates 36 are each secured at the spaces between the lower ends 16 of the columns 14, FIG. 5. Plates 36 form air-tight seals between each of the columns 14 and the lower flange of the main support beam 18 so that the incoming air is directed upwardly to the chamber 30. A plurality of air inlets 38 are formed along the cover sheet 34 of duct 32 communicating with a remote, mechanically forced-air source (not shown) to provide a regulated flow of air to the duct 32 and chamber 30. A baffle plate 40 is angularly positioned within the length of the duct 32 to restrict the incoming air path downwardly in the direction of the arrows in FIGS. 3 and 5 before entering the air chamber 30 in a uniform flow pattern.

Emergency air doors 42 are preferably formed at the ends of duct 32 which are adapted to be opened to provide a natural draft of air flow to the chamber 30 in the event of a power outage or failure of the forced or induced air fan system. The chamber 30 thus provides constant, free flow air cooling at the cool face of the suspended wall 2 which prevents oxidation and weakening of the hangers 10 and 12 without the damaging back pressures commonly experienced in the prior art. The upper end 44 of the air chamber 30 is open to the atmosphere, unrestricted by conventional dampers or the like. Thus, the cooling air stream flowing through the air chamber 30 is free to exit at upper end 44 thereof, FIG. 3, at the same velocity as it possesses during passage along the chamber whereby damaging back pressures within chamber 30 are eliminated. A back pressure within the air chamber 30 can cause a blow-out of the mortar at the joints between the refractory tiles 8 which results in the formation of objectionable "rat holes" and localized hot spots in the wall. The volumetric flow rate of air in the present invention is preferably regulated by conventional valve means such as guillotine-type damper, schematically shown at 46, positioned within the inlet ducts 38, FIG. 5. Thus, a back pressure in the air handling system exists downstream from the dampers 46 toward the mechanical draft source such as a fan (not shown) As a result of the unrestricted free air flow path existing from the duct 32 to the exit 44 of the air chamber 30, a natural chimney type of draft is established within the chamber 30 when the emergency doors 42 are opened which, as stated above, permits critical cooling of the wall components in the event of fan failure.

The hot face of the refractory tile array 8 is preferably coated with a refractory veneer layer 50. The veneer 50 is applied to the outer hot face of the refractory tiles 8 by way of known techniques. Refractory material such as highly refined silica, Tamul (sillimanite), ZRX, AZS, Zirmul and Vista may be used as the veneer layer 50, for example. The campaign life for the suspended wall 2 is a function of the basic mechanical design, the type of refractory material used, along with the thickness of the refractory tiles, that is, the dimension from the hot face to the cold face. Typical refractory tiles 8 have a dimension of 12 inches or 15 inches, measured from the hot face to the cold face. Ideally, the suspended backwall is designed to conform with the projected campaign life of the furnace in general.

In accordance with the present invention, a suspended furnace backwall 2, having 2 inch thick insulation slabs or batts 26 placed on the cold side of the refractory tiles 8, was found to exhibit greatly reduced temperature readings on the cold side of the furnace compared with uninsulated prior art walls. For example, with a furnace temperature of 2800° F., a 12 inch long refractory tile having a 2 inch thick insulation layer exhibited a cold face temperature at the outer side of the insulation 26 of 250° F. A 15 inch long tile with similar insulation had a temperature of 170° F. at the outer surface on the cold side thereof. This compares with an uninsulated refractory tile temperature of 500° F. for a 12 inch tile and 395° F. for a 15 inch tile. Both of the uninsulated refractory tiles were identically tested in a furnace environment having a temperature of 2800° F., for comparison purposes.

Ideally, in order to prevent weakening and oxidation of the cast malleable iron hanger brackets 10 and 12, the temperature of the metal hanger should be maintained below 250° F. in the exposed area where the cast hangers are attached to the vertical columns or stringers 14. More preferably, the temperature in this area should be maintained at about 150° F. or lower. These lower temperatures are, in fact, maintained when a free flowing air stream is present in the air chamber 30.

As seen in FIGS. 3, 5, 7 and 8, a space or gap 48 is provided between the cold face of the refractory tiles 8 and insulation layer 26 and the forward flanges 52 of the vertical stringers 14. In this manner, the free flowing air stream passing through the chamber 30 also flows within the space 48 to provide additional cooling of the hanger castings 10 and 12 and the forward flanges 52 of the stringers 14. The sheet metal wall 28 forming the air chamber 30 is attached to the stringers 14 in spaced relation from the rear flanges 54 thereof to form a gap or space 56 between the wall 28 and the flanges 54. The space 56 permits the free flow of air between the rear flanges and the sheet metal wall 28 to provide additional uniform cooling to the columns or stringers 14 around the rear flanges thereof. As a result of the improved suspended structure of the present invention, the structural integrity and unbalanced thermal expansion and stresses in the support structure are minimized.

Figure 4:
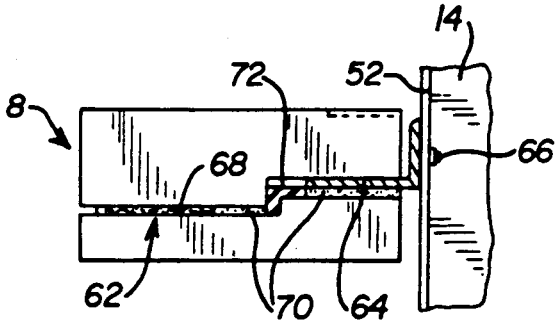
FIG. 4 is an enlarged, partial side view of an expansion joint from the wall construction shown in FIG. 3.
Figure 5:
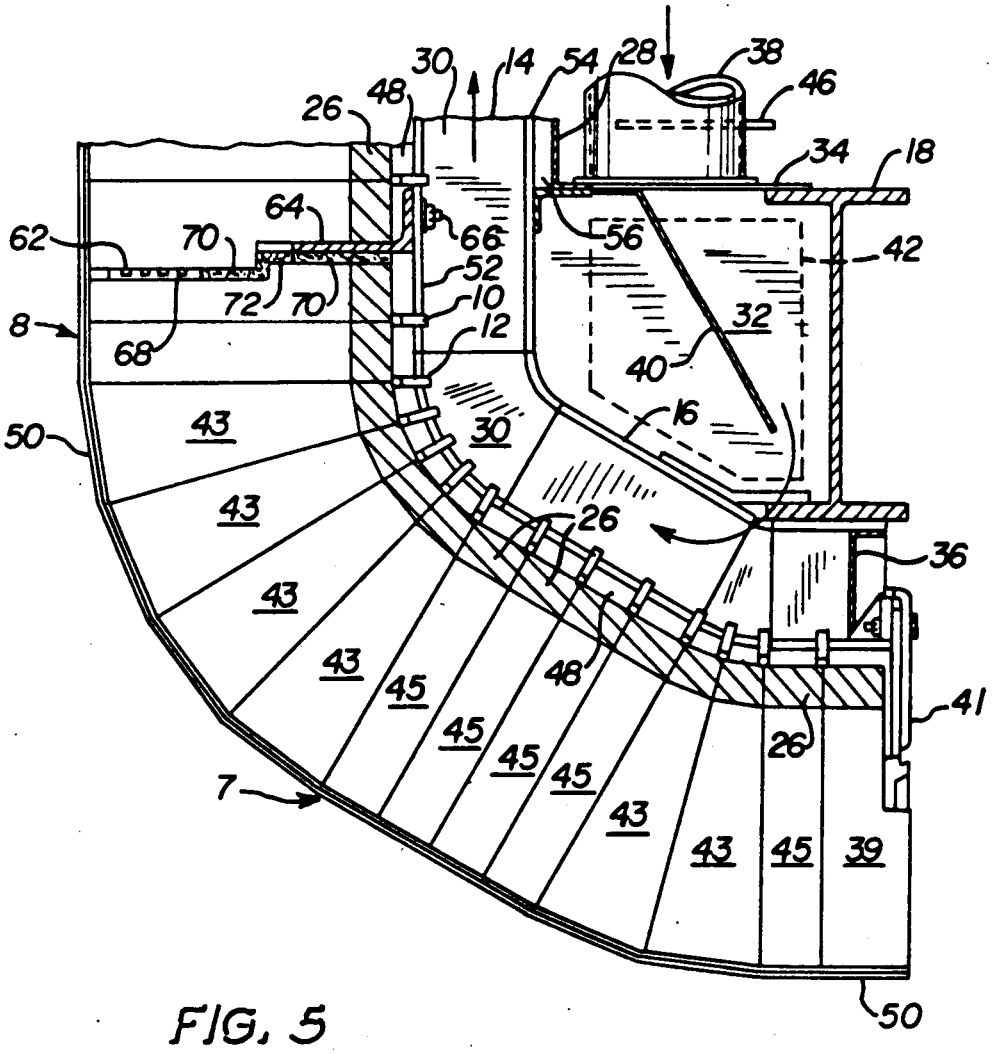
FIG. 5 is an enlarged, partial side view of the fritting chamber area of the wall of FIG. 3.

As seen in FIGS. 1, 3, 4 and 5, the wall 2 contains spaced, horizontal thermal expansion joints 62. A plurality of angle iron brackets 64 are attached by bolts 66 to the inner flanges 52 of the vertical columns 14. The brackets 64 are spaced-apart and extend in a horizontal direction along joints 62, each bracket having a length approximately the dimension of the width of the flange 52 of the spaced columns 14. Each bracket 64 supports the weight of a number of courses of the refractory tiles 8 thereon. For example, the brackets 64 in FIG. 3 are spaced-apart vertically to support the bearing load of five, six, seven or more courses of refractory tiles 8 positioned immediately above each of the respective brackets. As seen in FIGS. 4 and 5, the expansion joints 62 also include a dry glass fiber packing material 68 of, for example, Kaowool material. A packing mix 70 is also applied to the joint along with a heat-set mortar seal 72. The mortar 70, 72 and glass fiber 68 packing materials in the expansion joints 62 provide thermal protection for the angle iron brackets 64. Thus, the horizontal expansion joints 62 provide for a distribution of the refractory loading on the metal hanger brackets 64 in vertically spaced-apart, horizontally extending segments while also affording vertical expansion of the vertically segmented courses of refractory tiles 8. The vertical expansion of the refractory tiles 62 within the vertically segmented courses between the spaced, horizontally extending expansion joints 62 is further accommodated by the joint packing materials 68, 70 and 72 and by the moveable hanger castings 10 and 12.

Figure 10:
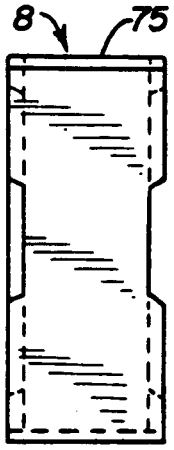
FIG. 10 is an end view of the tile of FIG. 9.
Figure 11:
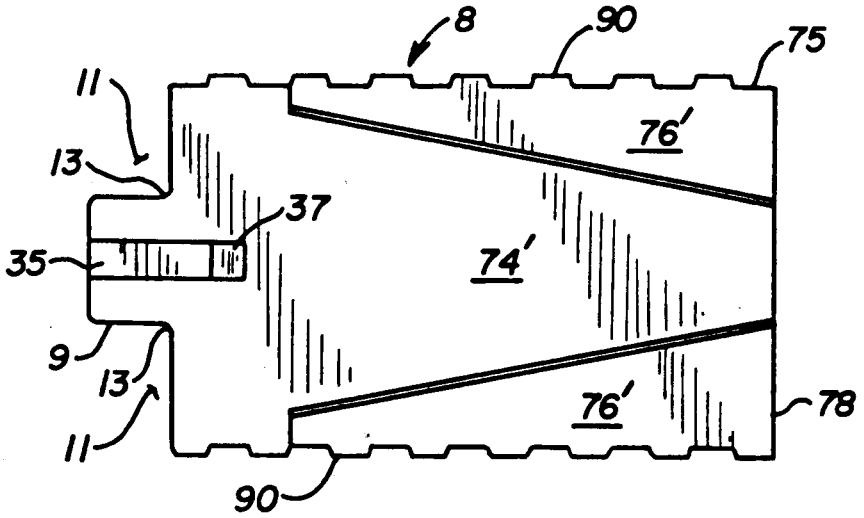
FIG. 11 is a bottom plan view of the tile of FIG. 9.
Figure 14:
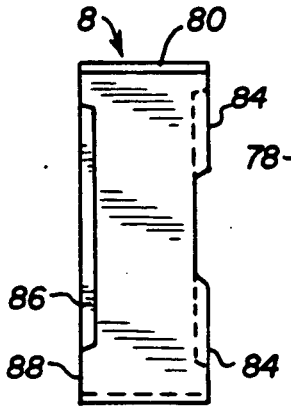
FIG. 14 is an end view of the tile of FIG. 13.

The wall 2 is preferably made-up of several basic configurations of refractory tiles 8 which all include mating tongue and groove surfaces The tiles 8 are preferably made from a cast and fired silica refractory material. Two of the common tile configurations are depicted in FIGS. 9 through 17. The cast metal hangers 10 and 12 for securing these refractory tiles to the vertical columns 14 are also depicted in greater detail in FIGS. 8–21. A first style of refractory tile 8 is shown in FIGS. 9–11 and designated by reference numeral 75, while a second configuration of tile is depicted in FIGS. 13–17 and designated 80. The refractory tiles 75 and 80 differ in the configuration of the tongue and groove mating features on the opposed horizontal faces thereof. More specifically, tile 75 comprises depressed tongue faces 74, which are bordered by raised tongue portions 76, such that the configuration of the depressed tongue faces 74 and 74' on the upper and lower faces of the tile 75 converge as the tongue face extends toward the hot face 78 of the tile. Tile 80 has a converging tongue face 82 bordered by raised tongue portions 84 which converge toward the hot face 78 of the tile. The reverse face of the tile 80 differs from the previously described tile 75 in that it contains a depressed groove face 86 which is bordered by raised surfaces 88 which converge as the face 86 extends toward the hot face 78 of the tile.

Figure 6:
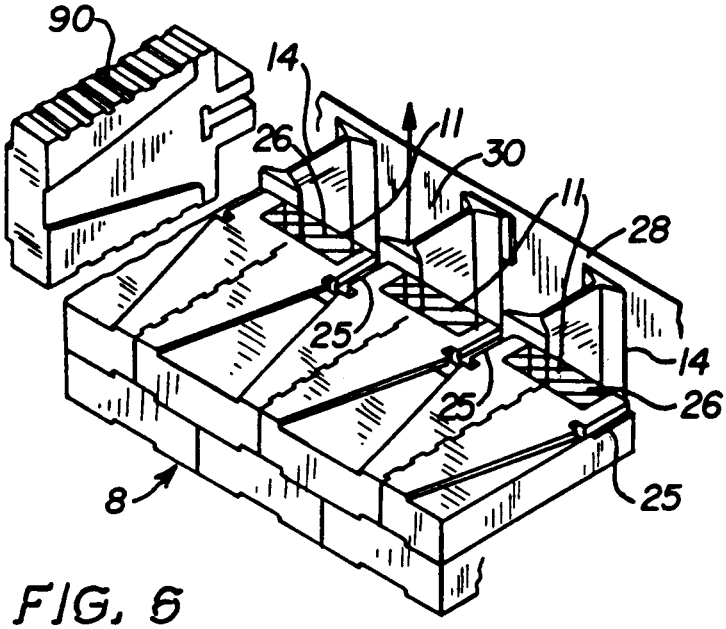
FIG. 6 is a fragmented, perspective view of several overlaid courses of interlocking refractory tiles used in the wall construction of the present invention.
Figure 7:
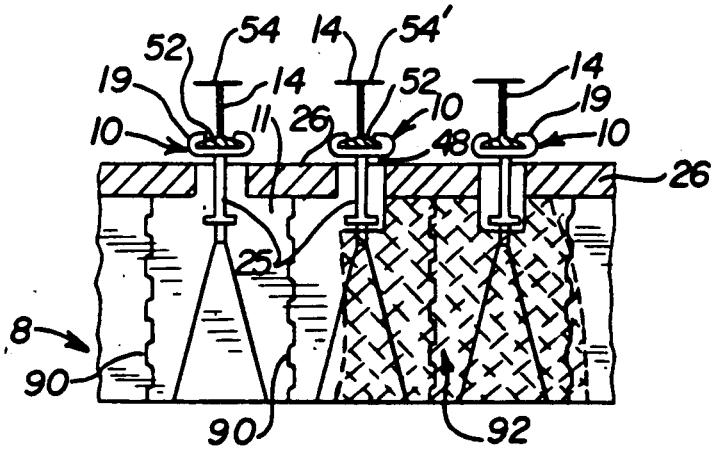
FIG. 7 is a fragmented, top plan view of the refractory tiles shown in FIG. 6.
Figure 8:
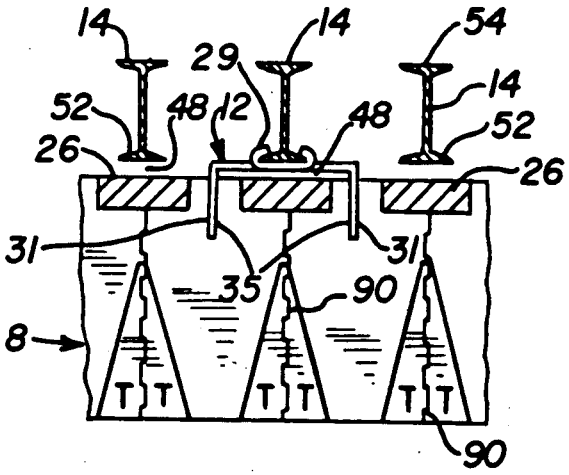
FIG. 8 is a fragmented, top plan view of a second course of refractory tiles placed over the course of tiles shown in FIG. 7.
Figure 9:
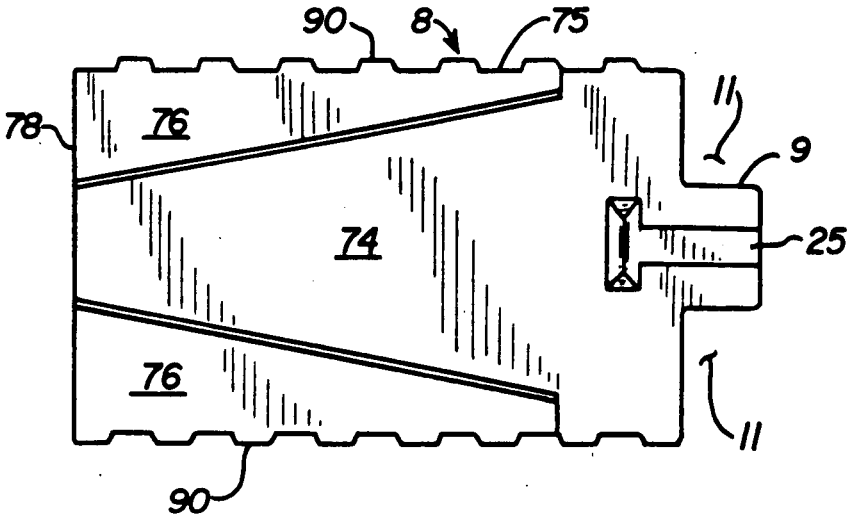
FIG. 9 is a top plan view of a type of refractory tile used in constructing a suspended structure in accordance with the invention.
Figure 12:
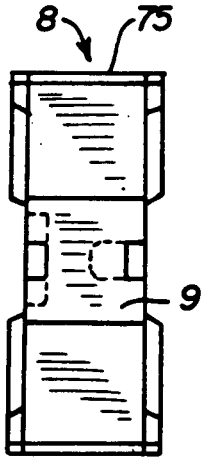
FIG. 12 is an end view of the tile of FIG. 11.

The lateral, vertical edges of all of the refractory tiles 8 contain mating ridges and grooves 90 as seen in FIGS. 6, 7 and 8. The refractory tiles 8 are laid in common brick laying fashion with staggered, overlapping courses. The tongue and groove portions of vertically adjacent tiles matingly engage one other on common horizontal planes separating two adjacent courses of tiles. The ridges and grooves 90 on horizontally adjacent side edges of the tiles within the same course also matingly engage adjacent tiles as they are laid in place. The tiles are laid and set using a layer of mortar 92 which is applied to the four sides of the tiles being joined. A typical mortar placement on the tiles 8 maintains a minimum of about ⅛ inch clearance, for example, around all of the connections with the metal casting hangers 10 and 12.

Figure 22:
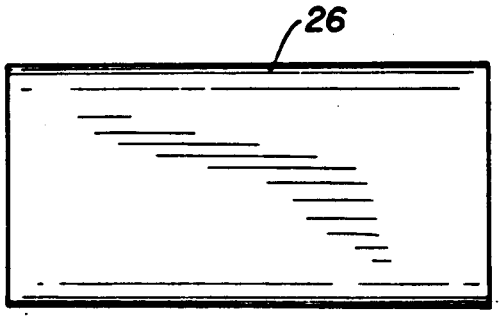
FIG. 22 is a plan view of a slab or batt of insulation used in the suspended wall of the present invention.
Figure 23:
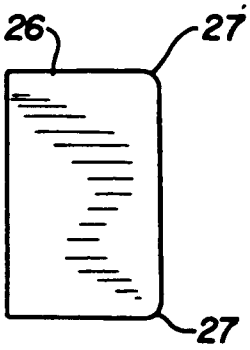
FIG. 23 is an end view of the slab or batt depicted in FIG. 22.

The tiles 8 have an extended neck portion 9 formed on the cold face thereof The extended neck 9 defines an adjacent open space 11 between horizontally adjacent tiles 8, which provides a space for the insertion of the insulation slabs or batts 26 therein, FIGS. 6–8. As seen in FIGS. 22 and 23, the insulation slab or batt 26 is formed in a rectangular shape in plan view having rounded edges 27 to substantially match a radius 13 formed at the corners of the extended neck portions 9 at the cold face of the tiles 8, see FIG. 11. The thermal insulation layer 26 is preferably constructed of a high temperature, porous refractory material. A high temperature, rigid, porous refractory insulation material such as "S" board is suitable.

Figure 13:
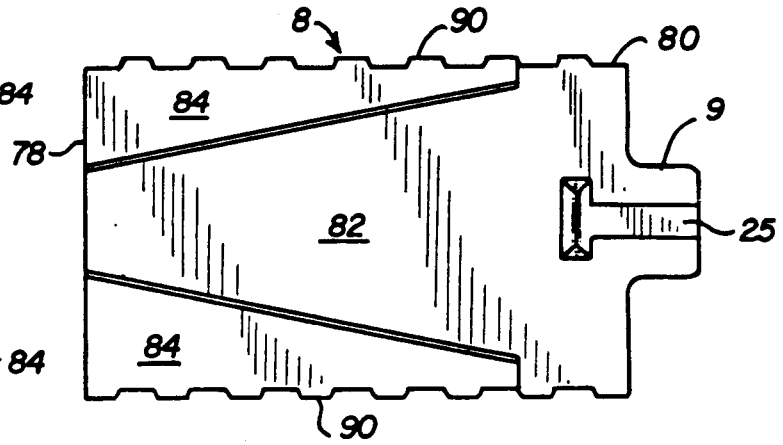
FIG. 13 is a top plan view of a further type of refractory tile used in constructing a structure in accordance with the invention.
Figure 16:
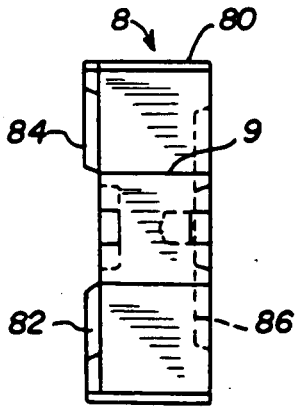
FIG. 16 is an end view of the tile of FIG. 15.
Figure 15:
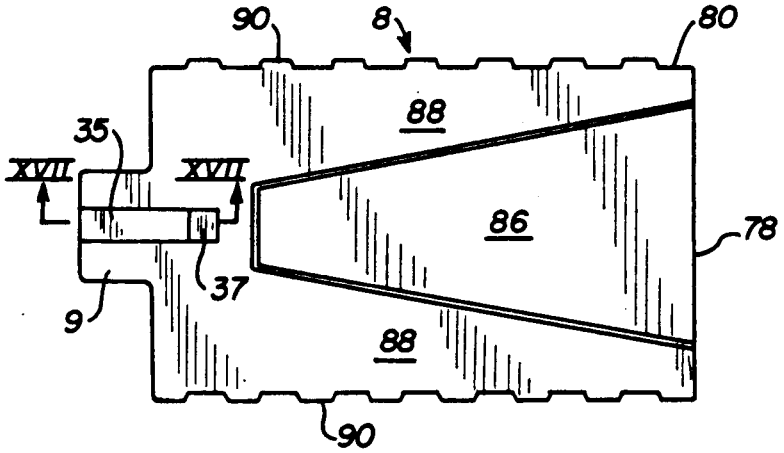
FIG. 15 is a bottom plan view of the tile of FIG. 13.
Figure 17:
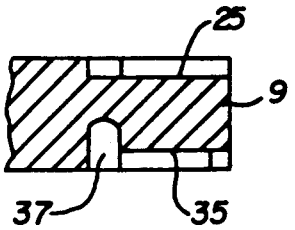
FIG. 17 is a section view of an extended neck portion of the refractory tile taken along line XVII—XVII of FIG. 15.
Figure 18:
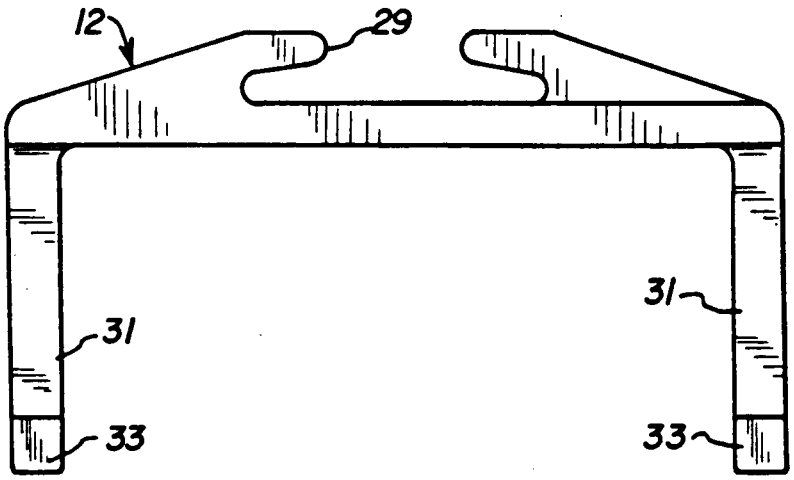
FIG. 18 is a plan view of one presently preferred style of tile hanger casting for use in constructing a suspended wall in accordance with the invention.
Figure 19:
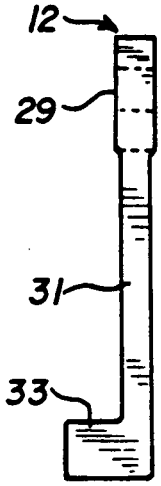
FIG. 19 is a side elevation view of the hanger of FIG. 18.
Figure 20:
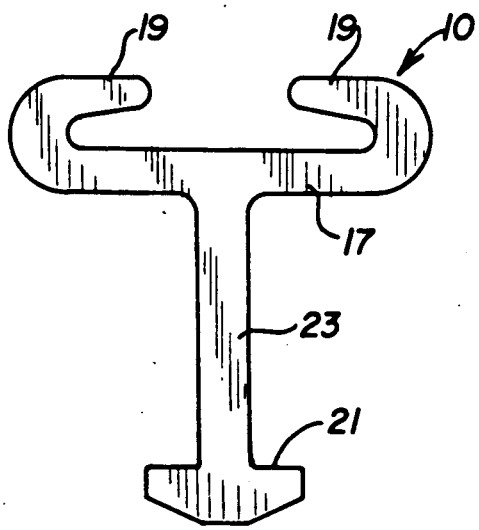
FIG. 20 is a plan view of a second style of tile hanger casting for use in constructing a wall in accordance with the invention.
Figure 21:
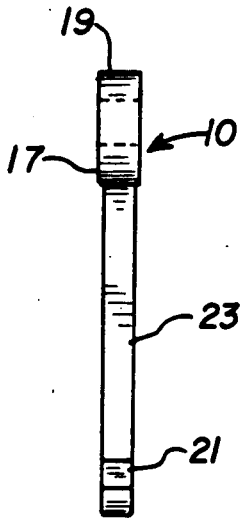
FIG. 21 is a side elevation view of the hanger shown in FIG. 20.

Since the alternating courses of refractory tiles 8 overlap one another, the extended neck portions 9 of one course of tiles will be in confronting alignment with the forward flanges 52 of the columns 14, while the next adjacent course of tiles will have each of its respective extended neck portions 9 positioned in the spaces midway between the columns 14. Because of this alternating alignment between the necks 9 and the columns 14, two different styles of cast hangers are required in order to secure the tiles to the columns. A first style of hanger 10 is depicted in FIGS. 20 and 21, while a second style 12 is depicted in FIGS. 18 and 19. The hangers are also shown in FIGS. 7 and 8. The hangers 10 are shown in slightly more detail, as in FIG. 7, while the hanger 12 is depicted in FIG. 8, joining the refractory tile 8 to the columns 14. The hangers are of a cast, ferrous material, such as malleable iron. Hangers 10 are generally T-shaped, having a cross-bar portion 17 with inwardly curved tines 19 defining a generally C-shaped gripping portion which is adapted to slidably encircle the flange 52 of an adjacent column 14 as shown in FIG. 7. The distal end of the hanger 10 has a refractory anchoring portion 21 which is also formed in a smaller T-shape configuration and joined to the cross-bar portion 17 by an elongated straight section 23. The cast hanger 10 is adapted to fit within a slot 25 formed in tile 8, as depicted in FIGS. 9 and 13. The slot 25 is formed within the extended neck portion 9 of the refractory tile such that the anchoring portion 21 of the hanger fits into the transverse T-portion of the slot 25, while the straight section 23 of the hanger lies within the straight portion of the slot 25. The hanger 10 is securely held in place within the slot 25 when an upper overlying course of tiles is cemented in place.

The second style of hanger 12, as shown in FIGS. 18 and 19, also has a generally C-shaped gripping portion 29 which is adapted to slidably fit around the inner flange 52 of the column 14. The hanger 12 includes a pair of spaced legs 31, having outwardly extending feet 33 as shown in FIGS. 18 and 19. The reverse faces of the tiles 8 have a slot 35 formed therein extending outwardly through the neck portion 9 thereof. As seen in the sectional view of FIG. 17, the groove 35 also includes a further downwardly recessed portion 37. Thus, the hanger 12 is adapted to span two adjacent refractory tiles, such that the legs 31 fit within the slots 35 of the respective tiles and the feet 33 extend downwardly into the recessed portion 37 of each tile. As seen in FIGS. 7 and 8, the aforementioned gap 48 provides a space for the metal hangers 10 and 12 in region of the gripping interface with the columns 14 for cooling air flow therebetween. The continuous flow of cooling air maintains the cast hangers at lower temperatures to insure that thermal weakening does not occur.

The C-shaped gripping portions defined at 19 and 29 of the respective hangers 10 and 12, slidably move along the flanges 52 of the columns 14 to accommodate thermal expansion or contraction in the vertical direction.

As seen in FIG. 5, the wall construction of the present invention allows convenient selection of several bottom slopes of between 30° to 60° to establish the most effective geometry of a fritting chamber 7 at the batch entrance. The angle of the fritting chamber is established by preselecting a particular degree of bending in the lower section 16 of the vertical columns or stringers 14.

A removable refractory nose tile 39 is provided at the lower course of the fritting chamber 7. The nose tile 39 is clamped in place at the end of the channels 14 by a metal retaining plate 41. In order to make the necessary transition from the vertical wall segment to the curved geometry of the fritting chamber 7, a plurality of wedge or pie-shaped refractory tiles 43 are employed. A plurality of parallel faced tiles 45 are also preferably employed in this curved area and are positioned between the pie-shaped tiles 43, as shown in FIG. 5. Thus, if need be, tiles can be removed and replaced from the cold face in this curved section by removal of the parallel faced tiles 45, which then permits the removal of the wedge or pie-shaped tiles 43. Naturally, the nose tile 39, having the removeable plate 41, is easily removed which provides a convenient feature since this course of tile is adjacent to the charger apparatus and is prone to damage and wear.

The refractory tiles 8 are installed using a full mortar bond which prevents the formation of so-called "rat holes", which result when the mortar is missing between adjacent tiles. The interlocking tongue and groove construction, as well as the ridges and grooves 90 along the edges of the tiles 8, provide interlocking on four sides of each of the refractory tiles. This four-sided interlocking tile construction with the integral insulation pockets permits the accommodation of the rear insulation without any risk to the structural integrity of the wall while also preventing transverse blow-out or "rat hole" formation.

The thermal expansion provisions of the joints 62, and the slidable hangers 10 and 12, as well as the lateral thermal expansion capabilities provided at the upper ends of the columns 14, provides exceptional thermal responsiveness and design integrity. The insulation on the rear face of the wall, along with the free flowing air, provides cooling to the cast metal hangers and columns which yields continual high strength and low maintenance. The free flowing air, with no back pressure within the chamber 30, provides an added measure of safety in the event of fan failure by establishing a natural draft current therethrough when the emergency doors 42 are opened.

Having described the invention, what is claimed is:

1. A suspended wall structure for use in a high temperature furnace comprising:

a plurality of spaced-apart, vertically extending columns;

means attached to lower portions and upper portions of the columns for supporting the columns within the furnace, wherein the upper portions of the columns are free to move in a lateral direction to accommodate thermal expansion and contraction;

a plurality of refractory members forming a refractory face along a first side of the columns;

thermal insulation means positioned between said refractory members and the first side of the columns;

hanger means for attaching said refractory members to the columns;

closure means for enclosing a second side of said columns, extending between adjacent columns and spaced from said thermal insulation means, forming a substantially continuous air chamber therealong; and duct means communicating with said air chamber and with a source of mechanically drafter air to cause an air flow through said air chamber to cool said hanger means and columns.

2. The structure of claim 1 wherein the means supporting the columns comprises a main support beam secured to a lower end portion of each of the columns and channel means attached to the first and second sides of the columns along an upper end portion of each, said channel means including horizontally extending flanges tranversing said columns across a horizontal length of said structure, and further comprising a pair of parallel, spaced-apart girders positioned on either side of the columns at the upper ends thereof, said girders having horizontally extending flanges positioned in spaced relation below said flanges of the channel means, and roller bearing means positioned between the flanges of the girders and channel means to moveable support a weight of said columns on the girders whereby said columns are laterally moveable on said roller bearing means to accommodate horizontal thermal expansion and contraction in said refractory members.

3. The structure of claim 2 wherein the means for attaching the refractory members along the first side of the columns includes a plurality of cast hangers, each having a C-shaped gripping portion which is fitted onto the first side of the columns and slidably moveable in a vertical direction thereon, whereby thermal expansion of said refractory members in a vertical direction is accommodated by sliding movement of said hangers along said columns.

4. The structure of claim 3, including thermal expansion joint means horizontally extending at spaced vertical locations between adjacent courses of refractory members along the refractory face of the structure to permit vertical thermal expansive movement of the refractory members, said expansion joint means also including a plurality of laterally spaced, metal support brackets attached to each of the columns adjacent the vertically spaced expansion joint means, each support bracket having a flange portion extending into said expansion joint means to support a bearing weight of refractory members positioned thereabove to a next adjacent expansion joint means.

5. The structure of claim 1 wherein the structure is a suspended backwall for a glass furnace.

6. The structure of claim 1 wherein the refractory members comprise refractory tiles of a rectangular shape including upper and lower side faces having mating tongue and groove surfaces formed thereon and side edges having mating ridges and grooves formed therein, whereby, when said refractory tiles are joined together, a mechanical interlock is formed on four sides of each of said tiles.

7. The structure of claim 6 wherein each of the refractory tiles has an extended neck portion formed along a narrow edge thereof facing the columns, whereby, when said tiles are attached to the hanger means in a joined condition, adjacent tiles in a common horizontal course of tiles, define an open space between the extended neck portions of the respective tiles, said open space receiving said thermal insulation means therein.

8. The structure of claim 1 wherein the air chamber has an unrestricted open outlet end providing free exhausting of said air flow therefrom and wherein the duct means includes emergency door means for selective opening to permit atmospheric air to enter the duct means and pass by a natural draft flow through said air chamber in the event of a failure in said mechanically drafted air source.

9. The structure of claim 1 wherein the refractory members comprise mechanically interlocked refractory tiles having mortar-bonded joints therebetween and wherein a hot face of said refractory tiles is coated with a refractory veneer.

10. The structure of claim 9 wherein the refractory tiles consist essentially of a silica material.

11. The structure of claim 9 wherein the structure is a suspended backwall for a glass furnace.

12. A suspended wall for a high temperature furnace comprising:

a plurality of spaced-apart, vertically extending columns having upper end portions and lower end portions, said lower end portions being uniformly bent in a rearward direction;

flanged girder horizontally extending across said furnace and positioned adjacent the upper end portions of said columns;

roller means associated with the upper ends of each of the columns for travel along an upper flanged surface of said girder means to permit horizontal movement of said columns in response to thermal expansion and contraction;

beam means horizontally transversing said wall and attached to the lower end portions of the columns to support a bearing weight of said columns;

a plurality of refractory members forming a refractory face along the columns;

hanger means for attaching the refractory members to the columns, each of said hanger means including a gripping portion for slidable engagement with said columns to permit vertical movement of said hanger means and tiles in response to thermal expansion and contraction;

thermal insulation means positioned between said refractory tiles and said columns;

closure means for enclosing a rear side of said columns, spaced from said thermal insulation means and forming an air chamber therein, said air chamber having an open end facing the upper end portions of the columns; and duct means communicating both with said air chamber and with a source of forced air to cause a stream of air to flow through said chamber and exit the open end thereof to cool said hanger means and columns.

13. The suspended wall of claim 12 wherein the duct means includes emergency door means for selectively opening to permit atmospheric air to enter the duct means and pass by a natural draft through said air chamber in the event of a failure in said forced air source.

14. The suspended wall of claim 12 including thermal expansion joint means horizontally extending at spaced vertical locations between adjacent courses of refractory members along the refractory face of the structure to permit vertical thermal expansive movement of the refractory members, said expansion joint means also including a plurality of laterally-spaced, metal support angles attached to each of the columns adjacent the vertically-spaced expansion joint means, each support angle having a flange portion extending into said expansion joint means to support a bearing weight of refractory members positioned thereabove to a next adjacent expansion joint means.

15. The suspended wall of claim 12 wherein the refractory members comprise refractory tiles of a rectangular shape including upper and lower side faces having mating tongue and groove surfaces formed thereon and side edges having mating ridges and grooves formed therein, whereby, when said refractory tiles are joined together, a mechanical interlock is formed on four sides of each of said tiles.

16. The suspended wall of claim 15 wherein the refractory tiles each have an extended neck portion formed along a narrow edge thereof facing the columns, whereby, when said tiles attached to the hanger means are in a joined condition, adjacent tiles in a common horizontal course of tiles, define an open space between the extended neck portions of the respective tiles, said open space receiving said thermal insulation means therein.

17. The suspended wall of claim 12 wherein the refractory members comprise mechanically interlocked refractory tiles having bonded joints therebetween and wherein a hot face of said refractory tiles is coated with a refractory veneer.

18. The suspended wall of claim 17 wherein the refractory tiles and refractory veneer consist principally of a silica material.

* * * * *

UNITED STATES PATENT AND TRADEMARK OFFICE

CERTIFICATE OF CORRECTION

PATENT NO. : 5,011,402

DATED : April 30, 1991

INVENTOR(S) : John A. Hammond

It is certified that error appears in the above-identified patent and that said Letters Patent is hereby corrected as shown below:

Column 5 Line 15 after "shown)" insert --.--.

Column 6 Line 45 after "surfaces" insert --.--.

Claim 1 Line 28 Column 9 "drafter" should read --drafted--.

Claim 2 Line 44 Column 9 "moveable" should read --moveably--.

Claim 12 Line 45 Column 10 after "girder" insert --means--.

Signed and Sealed this

Tenth Day of November, 1992

*Attest:*

DOUGLAS B. COMER

*Attesting Officer*

*Acting Commissioner of Patents and Trademarks*